United States Patent [19]

Schips

[11] Patent Number: 4,635,575

[45] Date of Patent: Jan. 13, 1987

[54] SEWING MACHINE FOR SEWING A RUBBER STRIP TO A TEXTILE FABRIC

[76] Inventor: Helmut Schips, Steinacher Str. 340, CH-9327, Tubach, Switzerland

[21] Appl. No.: 713,988

[22] Filed: Mar. 20, 1985

[30] Foreign Application Priority Data

Mar. 20, 1984 [DE] Fed. Rep. of Germany ..... 3410181

[51] Int. Cl.[4] ..... D05B 35/06

[52] U.S. Cl. ..... 112/121.26; 112/136; 112/305

[58] Field of Search ..... 112/121.26, 121.27, 112/136, 305, 306, 106, 129, 130, 104, 105, 235

[56] References Cited

U.S. PATENT DOCUMENTS

| | | | |
|---|---|---|---|
| 2,153,244 | 4/1939 | Galkin | 112/121.26 |
| 2,329,991 | 9/1943 | Kellum | 112/235 X |
| 3,847,099 | 11/1974 | Braun | 112/121.26 X |
| 3,857,346 | 12/1974 | Dal Negro | 112/130 |
| 3,964,410 | 6/1976 | Boser et al. | 112/121.26 |
| 4,020,776 | 5/1977 | Haff, Jr. | 112/121.26 |
| 4,067,273 | 1/1978 | Marforio | 112/121.26 X |
| 4,281,608 | 8/1981 | Mitani et al. | 112/121.26 X |

FOREIGN PATENT DOCUMENTS

| | | |
|---|---|---|
| 675241 | 5/1939 | Fed. Rep. of Germany . |
| 2828984 | 1/1979 | Fed. Rep. of Germany . |

*Primary Examiner*—Werner H. Schroeder
*Assistant Examiner*—Andrew M. Falik
*Attorney, Agent, or Firm*—Wigman & Cohen

[57] ABSTRACT

A sewing machine for sewing a rubber strip to a tubular end section of an item of clothing made from an elastic, textile fabric to form an endless, elastic gather, has a feed mechanism for feeding the rubber strip, and a presser foot and transportor for feeding the item of clothing. A brake and shear are positioned in the path of the rubber strip. When actuated, the brake holds the end section of rubber strip under a desired tension so that the end of the strip is precisely sewn to the item of clothing with respect to the front edge of the strip. Additionally, a light barrier is positioned in the path of the strip which has been sewn to the item of clothing to control the feed mechanism for feeding the rubber strip, the shear, and the brake.

11 Claims, 2 Drawing Figures

SEWING MACHINE FOR SEWING A RUBBER STRIP TO A TEXTILE FABRIC

BACKGROUND OF THE INVENTION

The invention relates to a sewing machine for sewing a rubber strip to a tubular end section of an item of clothing.

In sewing a rubber strip to a tubular end section of an item of clothing made of an elastic, textile fabric to form an endless, elastic gather, the supplied rubber strip must be held under a certain tension until it is sewn to the material. In known sewing machines this tension is produced with the aid of the feed mechanism which transports the rubber strip stepwise and holds it rigidly clamped in place between the individual transport steps. However, because the feed mechanism as well as the shear that cuts the rubber strip are both arranged at a certain distance from the transporting device, in these known sewing machines there is an end piece of the rubber strip still unsewn after the cutting step that can no longer be controlled by the feed mechanism. This results not only in the fact that this end section is sewn without any tension, but that it can also be sewn with the edges crooked.

OBJECTS AND SUMMARY OF THE PRESENT INVENTION

The object of the invention is to create a sewing machine for the automatic sewing of a rubber strip to a tubular end section of an item of clothing made from an elastic, textile fabric to form an endless, elastic gather, by means of which not only an exact, even-edged sewing of the rubber strip is possible, but also by which the sewing of the end section takes place under the same conditions as the remaining sections, and the connecting of the beginning and end of the rubber strip takes place to form an overlap or a joint.

By means of a brake, a controlled feed of the rubber strip is possible even after the cutting and release from the feed mechanism, i.e., even the end section of the rubber strip can be held under the desired tension until the conclusion of the sewing process and can be precisely supplied to the presser foot. This assures straight-edged sewing. In addition, it is not difficult to sew the beginning and end of the rubber strip together with a desired overlapping or to form a blunt joint.

If the brake is formed according to the present invention, as a friction brake, then the required braking effect can be varied with the aid of a clamping force which is exerted on the rubber strip by clamping elements. To provide lateral guidance for the strip, the clamping elements of the friction brakes, which are preferably formed as plates, can be provided with corresponding guide elements.

To permit the brake to maintain control of the strip end until the strip end reaches the presser foot, it is advantageous for the brake to be arranged as near the presser foot as possible. In a preferred embodiment, therefore, the counter plate formed by one of the clamping elements of the brake, against which a presser foot formed by the other clamping plate can be moved, is formed by an extension of the presser foot on the feed side of the material.

Both with respect to a simple activation of a compression plate, which is preferably mounted so as to be pivotable, and with respect to the possibility of varying the force with which the compression plate presses against the rubber strip, in a preferred embodiment, the drive for the compression plate is provided as a pneumatic cylinder.

The feed mechanism is preferably controlled by drivable transport rollers which are controlled by means of a step motor. Synchronizing the drive movement of the step motor with the drive of the transporter permits a very precise adjustment of the tension in the rubber strip and also a maintenance of this tension during the entire sewing process.

A shear for cutting the rubber strip is advantageously arranged immediately behind the transport rollers. Shortly before the rubber strip is cut at its end, it is taken hold of by the brake. A sensor is advantageously provided to control the shear and the brake. The signal of the sensor, which can advantageously be a light barrier, can also be used to control the sewing process itself. For example, at the signal of the sensor, the sewing process can be continued for a selectable number of stitches after the rubber strip has been completely sewn into the desired position and has been sewn to its end. Thereafter the sewing process is automatically ended.

It is preferable to extend not only the presser foot but also the transporter toward the feed direction of the material in order to assure a reliable gripping of the approaching start of the already sewn rubber strip.

Preferably, between the point at which the sensor is arranged and the point at which the rubber strip is sewn to the material, there is arranged a knife blade running in the direction of sewing. This blade can be raised above the stitch plate of the sewing machine and cuts the edge of the material before it is sewn to the rubber strip, so that even on the inside of the rubber strip there is a clean edge of the material of the item of clothing. If the sensing detects the beginning of the already sewn rubber strip, then after passing a predetermined transport path of the material, the blade is lowered beneath the stitch plate so that the beginning of the already sewn rubber strip is not cut by the blade.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
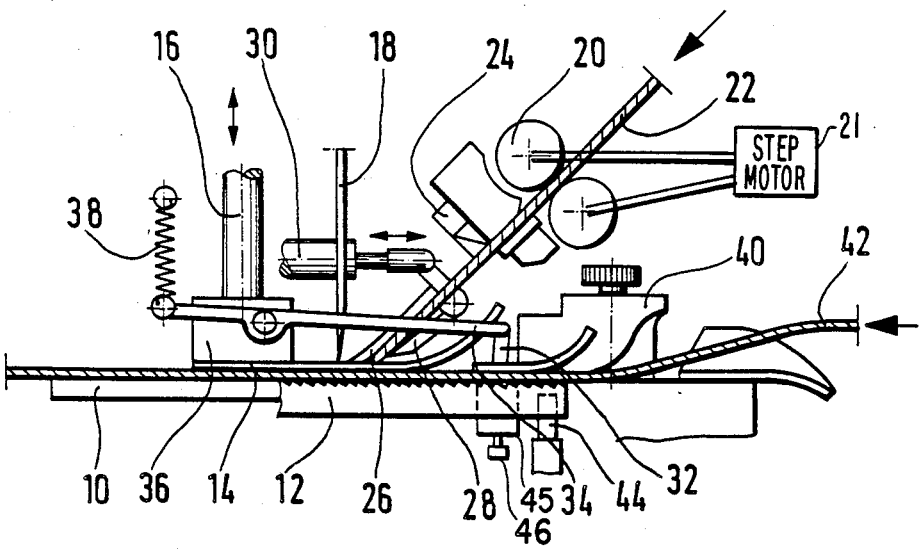
FIG. 1 is a schematic side view of a portion of a sewing machine according to the present invention.

In the drawing, only those elements of the sewing machine important to the invention are illustrated. The parts of the sewing machine not shown in the drawings are formed in a conventional manner, so that a description of these elements is not necessary.

The sewing machine has a sewing machine table having an inserted stitch plate 10. A transporter 12 extends through the stitch plate 10 from beneath. A presser foot 14, which can be raised and lowered by means of a presser foot bar 16, is arranged above the stitch plate 10. The needle 18 of the sewing machine sews through the presser foot 14.

Above the sewing tools (stitch plate, transporter, presser foot, needle) and in front of them is arranged a pair of transport rollers 20, which are driven by an electrical step motor 21. A rubber strip 22, which forms the rubber blank to be sewn in place, is fed between the transport rollers 20. The rubber strip 22 is drawn through the transport rollers 20 from a supply spool and is supplied to the sewing tools. A controlled drivable shear 24 is arranged in the feed direction of the rubber strip 22 immediately behind the transport rollers 20 to cut the passing rubber strip 22. After the shear 24, the rubber strip passes beneath an upwardly curved beak 26 of the presser foot 14. Arranged on the beak 26 is a compresson plate 28, which is pivotable about an axis disposed laterally to the feed direction of the rubber strip 22.

A piston rod of a pneumatic cylinder mechanism 30 engages with a pivot lever, which, inturn, is connected with the compression plate 28. The rubber strip 22 passes between the upwardly curved beak 26 of the presser foot 14 and the compression plate 28. The compression plate 28 can be pivoted towards the beak 26 by means of the pneumatic mechanism 30, whereby it presses the passing rubber strip 22 against the beak 26, so that the rubber strip 22 passes between the beak 26 and the compression plate 28 with friction and is braked thereby, and is guided parallel thereto by lateral guide elements, such as raised lateral edges 29.

An auxilliary foot 32 is arranged in front of the presser foot 14, in the sewing direction. The auxilliary foot 32 is arranged on an arm of a two-armed lever 34, which is pivotably mounted on a block 36 of the presser foot 14. An extension spring 38 engages the other arm of the two-armed lever 34, so that the auxilliary foot 32 is pressed against the stitch plate 10. The transporter 12 is extended at least with one of its toothed rows beyond the stitch plate 10 to the auxilliary foot 32. A guide 40, which can be screwed to the stitch plate 10, serves to direct the entering material 42 of the item of clothing reliably beneath the auxilliary foot 32.

Figure 2:
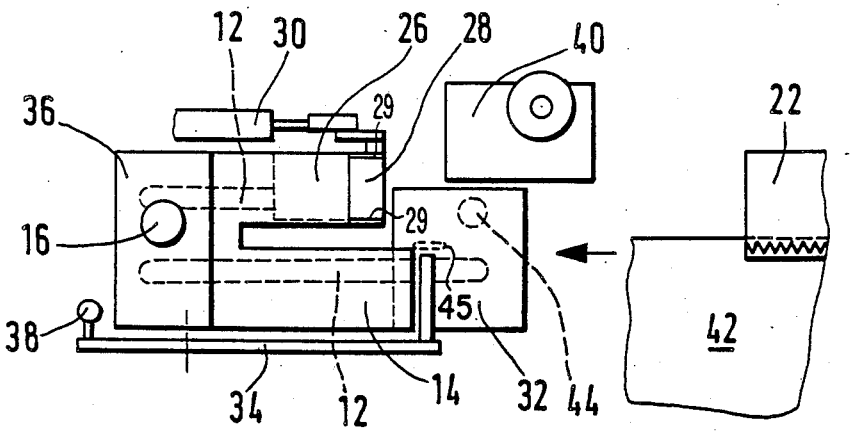
FIG. 2 is a top view of the presser foot of this sewing machine.

The sender and/or receiver of a light barrier 44 are arranged beneath the auxilliary foot 32 in the stitch plate 10. The barrier, as shown in FIG. 2, is directed toward the path of the rubber strip 22 that has already been sewn to the material 42.

A knife blade 45 is provided in the stitch plate 10 in the sewing direction between the light barrier 44 and the needle 18. The blade runs in the sewing direction and can be controlled to be lowered beneath the stitch plate 10 as by blade lowering device 46.

The step motor 21 that drives the transport rollers 20 is synchronized with the drive of the sewing tools. Both the drive of the sewing machine and the step motor driving the transport rollers 20, as well as the pneumatic activations of the shear 24, the pneumatic mechanism 30 and the lowering of the blade 45 can be controlled by the signal from the light barrier 44.

The sewing machine operates in the following manner:

The edge of the tubular item of clothing to which the rubber strip is to be sewn is placed beneath the presser foot 14 of the sewing machine. Then the operating cycle begins. The blade 45 is raised above the stitch plate 10, the transporter 12 is placed into operation, the transport rollers 20 for feeding the rubber strip 22 are driven and the compression plate 28 is pivoted away from the beak 26 of the presser foot.

The material 42 of the item of clothing is then fed in the direction of the arrow by the transporter 12, whereby its edge is cut straight in the sewing direction by the raised blade 45. As soon as the beginning end of the rubber strip 22 arrives beneath the needle 18, the sewing process is started. The rubber strip 22 is sewn to the edge of the material 24. The drive of the transport rollers 20 by the step motor is synchronized with the feed movement of the transporter 12 and the step motor is controlled such that the rubber strip 22 is fed at a somewhat lower speed than the material 42. The transport rollers 20 therefore hold the rubber strip at the entrance under the presser foot 14 under a certain tension. The sewing process is continued until the rubber strip 22 is sewn nearly to the entire periphery of the item of clothing. Then the beginning end of the rubber strip 22 sewn to the material 42 again approaches the sewing tools, as indicated in FIG. 2. The light barrier 44, which is located outside the edge of the material 42 and has therefore until now been free, is now interrupted by the beginning end of the sewn rubber strip 22 and gives a signal to the controls of the sewing machine.

In response to this control signal from the light barrier 44 the blade 45 is lowered beneath the stitch plate 10 so that it does not cut the already sewn rubber strip 22. At a preselected time period after the control signal of the light barrier 44 the transport rollers 20 are stopped, the shear 24 is activated, and the compression plate 28 is pivoted toward the beak 26. This preselectable time period corresponds to a preselected feed path of the rubber strip 22, so that the length of the end of the rubber strip 22 can be precisely preselected so that it will still be sewn after the beginning edge of the sewn rubber strip has reached the light barrier 44. It can be selectably determined whether the beginning and the end of the rubber strip will join each other bluntly or will be sewn with a preselectable length of overlapping.

The pivoting of the compression plate 28 toward the beak 26 of the compression foot 14 frictionally clamps the rubber strip 22 in place. The transporter 12 draws the rubber strip 22 against the braking effect of the compression plate 28 during continued sewing, so that during continued sewing the rubber strip is held under tension, even though it has been cut by the shear 24, and is no longer held by the transport rollers 20.

After a predetermined number of stitches after the control signal of the light barrier 44, the sewing process is ended. This number of stitches is selected so that a complete overstitching of the end of the rubber strip takes place. At the conclusion of the sewing process a thread cutter is activated in a conventional manner and the presser foot is raised, so that the item of clothing with the completely sewn rubber strip can be removed from the sewing machine.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A sewing machine for sewing a rubber strip to a tubular end section of an item of clothing made from an elastic, textile material while forming an endless, elastic gather, comprising:

a presser foot for pressing the material to be sewn against a support;

a transporter for transporting the material to be sewn;

a feed mechanism which supplies the rubber strip to the presser foot;

a separating device for the rubber strip; and a brake for acting on the rubber strip located between the feeding mechanism and a point at which the presser foot begins to press the supplied rubber strip against the support, wherein the brake is formed as a friction brake with clamping elements that can be pressed against each other, between which the rubber strip is gripped, wherein, one clamping element is formed as a pivotably mounted compression plate which can be moved against a counter plate which forms the other clamping element, and wherein the brake includes guide elements which laterally guide the rubber strip.

2. A sewing machine according to claim 1, wherein the guide elements are provided on a least one of the two plates.

3. A sewing machine according to claim 1, wherein the counter plate is formed by an extension of the presser foot on the material feed side and the compression plate is arranged opposite the underside of the counter plate.

4. A sewing machine according to claim 3, wherein the transporter is extended toward the material feed side.

5. A sewing machine according to claim 1, further comprising a pneumatic cylinder for driving the pivotably mounted compression plate.

6. A sewing machine according to claim 1, wherein the feed mechanism comprises drivable transport rollers which are controlled by a step motor.

7. A sewing machine according to claim 6, wherein the step motor has a drive which is synchronized with the transporter for transporting the material to be sewn.

8. A sewing machine according to claim 7, further comprising a sensor for the beginning of the rubber strip, which has been sewn to the material and together with the material is approaching the presser foot to control the brake and the separating device, which is a shear arranged between the feed mechanism and the brake.

9. A sewing machine according to claim 8, wherein the sensor comprises at least one light barrier.

10. A sewing machine according to claim 9, further comprising a blade lowering device which can be controlled by the sensor.

11. A sewing machine for sewing a rubber strip to a tubular end section of an time of clothing made of an elastic, textile material to form an endless, elastic gather, comprising:

a support;

a presser foot which presses the material to be sewn against the support;

means for transporting the material to be sewn;

a feed mechanism for supplying the rubber strip to the presser foot;

means for cutting the rubber strip; and between the supply device and the presser foot, immediately before the point at which the presser foot begins to press the supplied rubber strip against the support, a brake is provided which is capable of acting on the rubber strip and is formed as a friction brake with an adjustable braking effect, wherein the friction brake comprises clamping elements which can be pressed toward each other and grasp the rubber strip between them.

* * * * *